United States Patent [19]

Oesterle et al.

[11] 4,438,791

[45] Mar. 27, 1984

[54] WEFT THREAD-SELECTION APPARATUS FOR A WEAVING MACHINE

[75] Inventors: Gerhard Oesterle, Koblach, Austria; Rudolf Jaeger, Frasnacht, Switzerland; Wilhelm Hutter, Roggwil, Switzerland; Elmar Zanol, Arbon, Switzerland

[73] Assignee: Aktiengesellschaft Adolph Saurer AG, Arbon, Switzerland

[21] Appl. No.: 381,569

[22] Filed: May 24, 1982

[30] Foreign Application Priority Data

Jun. 9, 1981 [CH] Switzerland ..... 3750/81

[51] Int. Cl.[3] ..... D03D 47/38

[52] U.S. Cl. ..... 139/453

[58] Field of Search ..... 139/453; 66/127

[56] References Cited

U.S. PATENT DOCUMENTS

| | | | |
|---|---|---|---|
| 3,315,708 | 4/1967 | Scheffel | 139/453 |
| 4,076,054 | 2/1978 | Merisio | 139/453 |
| 4,132,249 | 1/1979 | Camprubi | 139/453 |
| 4,191,222 | 3/1980 | Marshall | 139/453 |
| 4,298,034 | 11/1981 | Viscardi | 139/453 |

FOREIGN PATENT DOCUMENTS

| | | | |
|---|---|---|---|
| 458695 | 7/1950 | Italy | 139/453 |
| 2,059,459 | 4/1981 | United Kingdom | 139/453 |

*Primary Examiner*—Henry Jaudon

*Attorney, Agent, or Firm*—Werner W. Kleeman

[57] ABSTRACT

A weft thread-selection apparatus for a weaving machine or loom comprises a carrier or support element which oscillates or pivots in cycle with the weft thread-insertion frequency. The oscillatable support element carries at its free end a number of electromagnetic devices, for instance electromagnets corresponding to the number of thread infeed rods and is rotatably supported at its other end for pivotal movement about a shaft. This shaft simultaneously constitutes the pivot point for oscillatable or pivotal arm members, each of which is retained under the action of spring means in its preparatory position. Each of the oscillatable or pivotal arm members is hingedly connected at its free end with one of the thread infeed rods and each oscillatable arm member carries a magnet armature intended to cooperate in a coupling fashion with one of the electromagnets. The row of electromagnets extends below the oscillatable or pivotal arm members. The electromagnets, when magnetically coupled with the magnet armatures located at the oscillatable arm members, drag these arm members into their thread transfer position. These measures afford a particularly simple and robust, easy to control weft thread-selection apparatus.

10 Claims, 2 Drawing Figures

WEFT THREAD-SELECTION APPARATUS FOR A WEAVING MACHINE

BACKGROUND OF THE INVENTION

The present invention relates to a new and improved construction of a weft thread-selection apparatus for a weaving machine or loom.

Generally speaking, the weft thread-selection apparatus for a weaving machine operates with individual or multiple weft thread insertion and withdraws the filling or weft thread from supply bobbins or spools located externally of the weaving shed. Each weft thread which is to be inserted, prior to its insertion into the shed, is brought by a related weft thread-infeed device of the weft thread-selection apparatus out of a preparatory position into a transfer position serving for the thread transfer to the weft thread-insertion device. The weft thread-infeed device can be connected by means of an electromagnetic control to a to-and-fro driven entrainment device.

Weft thread-selection apparatuses of this type encompass a plurality of adjacently arranged weft thread-infeed devices, each of which guide a weft or filling thread, and which are program-controlled in cycle with the weft thread insertion.

A weft thread-selection apparatus of the aforementioned type is disclosed, for instance, in Swiss Pat. No. 610,367. With this selection apparatus each linearly guided weft thread-infeed device is hingedly connected by means of a connecting rod with one end of a double oscillating or pivotal lever, the other end of which can be selectively fixedly retained or released by an electromagnetically actuatable locking device. An oscillating drive in the form of a cam-driven arm member, which is pivotable or oscillatable about a stationary shaft and engaging at the aforementioned double oscillating lever by means of a bracket member, forces this double oscillating lever to undertake an oscillatory movement. If the locking device is in its locking position then the oscillatory movement is accomplished about the end fixedly retained by the locking device. On the other hand, if the locking device is in its release position then the oscillatory movement is accomplished about the other end of the oscillatory lever which is held in its preparatory position under the action of a spring. Consequently, the selected thread infeed device is only then brought out of the preparatory position into its transfer position when the locking device fixedly retains the one end of the double oscillatory lever.

However, with this prior art construction there prevails the appreciable drawback that it requires numerous components or parts for each weft thread-infeed device as well as thrust armature magnets. Such prior art design of weft thread-selection apparatus therefore is complicated, prone to malfunction or disturbances and expensive. Additionally, this state-of-the-art apparatus requires a timewise exact current infeed and current interruption for the electromagnets in order to accomplish an exact control operation. Also there are needed facilities for exactly maintaining the thread infeed device in its preparatory position, in order to ensure for the latching or locking of the retention locking device.

A weft thread-selection device of the type here under discussion is also known to the art from Swiss Pat. No. 532,671. With this prior art construction a transfer or transmission element connected with the related thread infeed device which is to be actuated is brought by the thrust armature of a related electromagnet into the effective or operative region of a cutter which is continuously moved to-and-fro. By virtue of the effective contact between the transfer or transmission element and the cutter the related thread infeed device moves out of its preparatory position into a transfer position serving for the thread transfer to the weft thread-insertion device. The effective contact between the transfer element and the cutter is ensured for by a spring-loaded pawl element.

Also this heretofore known arrangement contains numerous, and thus, complicated components or parts for each thread infeed device. Additionally, with this prior art construction there are used expensive thrust armature magnets. Although the feature of providing an operative connection between the transfer elements and the cutters avoids the necessity of providing an exact current control for the electromagnets, nonetheless such design still demands an additional high constructional expenditure, and furthermore, is afflicted with the drawback that there is produced an appreciable amount of noise.

In Austrian Pat. No. 257,506 there is disclosed an arrangement containing a transversely travelling slide member and an electromagnetically actuated pawl arrangement. Also this equipment is extremely complicated in its construction and, already for such reason, quite prone to malfunction.

In British Pat. No. 1,467,231 there is disclosed an apparatus containing a lift arrangement supporting a multiplicity of magnets and which moves needles up and down when there is established an appropriate magnetic coupling.

SUMMARY OF THE INVENTION

Therefore, with the foregoing in mind it is a primary object of the present invention to provide a new and improved construction of a weft thread-selection apparatus for a weaving machine which is not associated with the aforementioned drawbacks and limitations of the prior art constructions.

Another and more specific object of the present invention aims at the provision of a new and improved construction of a weft thread-selection apparatus of the previously mentioned type which, while avoiding the drawbacks of the known arrangements, consists of a noteworthy few number of components or parts, can be designed without the need for thrust armature-electromagnets, and therefore is reliable in operation, not prone to any appreciable wear, operates at a low noise level, and affords an extremely accurate mode of operation.

Yet a further significant object of the present invention is directed to a new and improved construction of a weft thread-selection apparatus for a weaving machine, which is relatively simple in construction and design, economical to manufacture, extremely reliable in operation, not readily subject to breakdown or malfunction, and requires a minimum of maintenance and servicing.

Now in order to implement these and still further objects of the invention, which will become more readily apparent as the description proceeds, the inventive weft thread-selection apparatus is manifested by the features that, the entrainment device comprises a support or carrier element which oscillates in cycle with the weft thread insertion frequency. The support element carries at its free end a number of electromagnetic devices or means, particularly either electromagnets or magnet armatures, corresponding to the number of thread infeed rods. The support element is rotatably supported at its other end about a pivot shaft or axis, this pivot shaft simultaneously constituting the pivot point for oscillatable or pivotal arm members. Each of these oscillatable arm members is retained under the action of spring means in its preparatory position. Furthermore, each of the oscillatable or pivotal arm members is hingedly connected at its free end with one of the thread infeed rods, and each oscillatable or pivotal arm member carries a respective magnet armature or electromagnet of the related electromagnetic device intended to be operatively couplingly associated with one of the electromagnets or magnet armatures of such electromagnetic device.

This construction enables dispensing with the heretofore conventional mechanical connection or coupling means between the revolving or oscillating drive means and the intermediate elements actuating the thread infeed rods, and also enables dispensing with the use of expensive and disturbance-prone thrust armature magnets. This is so because, with the inventive design, simple electromagnets, in coacting relationship with armature means provided at the oscillatable arm members moving the thread infeed rods, establish a direct entrainment connection by providing a magnetic coupling between the oscillatable arm members and the support element which oscillates at the weft thread-insertion frequency. This allows for a simple, practically disturbance-free and cost-favourable construction of such weft thread-selection apparatus.

According to a preferred construction of the inventive weft thread-selection apparatus the support or carrier element comprises a transverse web member which extends over all adjacently arranged oscillatable or pivotal arm members. This transverse web member carries the electromagnets or magnet armatures, as the case may be, which are arranged adjacent one another at essentially the spacing of the oscillatable arm members or is constructed as a magnet armature. An advantageous further construction of the invention resides in the features that, the row of the electromagnets or magnet armatures extend below the oscillatable arm members, and the electromagnets, when magnetically coupled with the magnet armatures, entrain or drag the oscillatable arm members into their transfer position.

It is further advantageous if the support element is actuatable by means of a revolving control cam. It is then desirable if the support element bears by means of a contact roll at the control cam and if a tension spring or equivalent element engages at the support element.

Furthermore, to ensure for a simple linear guiding of the thread infeed rods it is advantageous if a respective guide rod is hingedly connected at the free end of each thread infeed rod.

For the purpose of energising the electromagnets there can be used program-controlled circuit arrangements of random design for the current infeed and current interruption, for instance punch card controlled switching systems.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
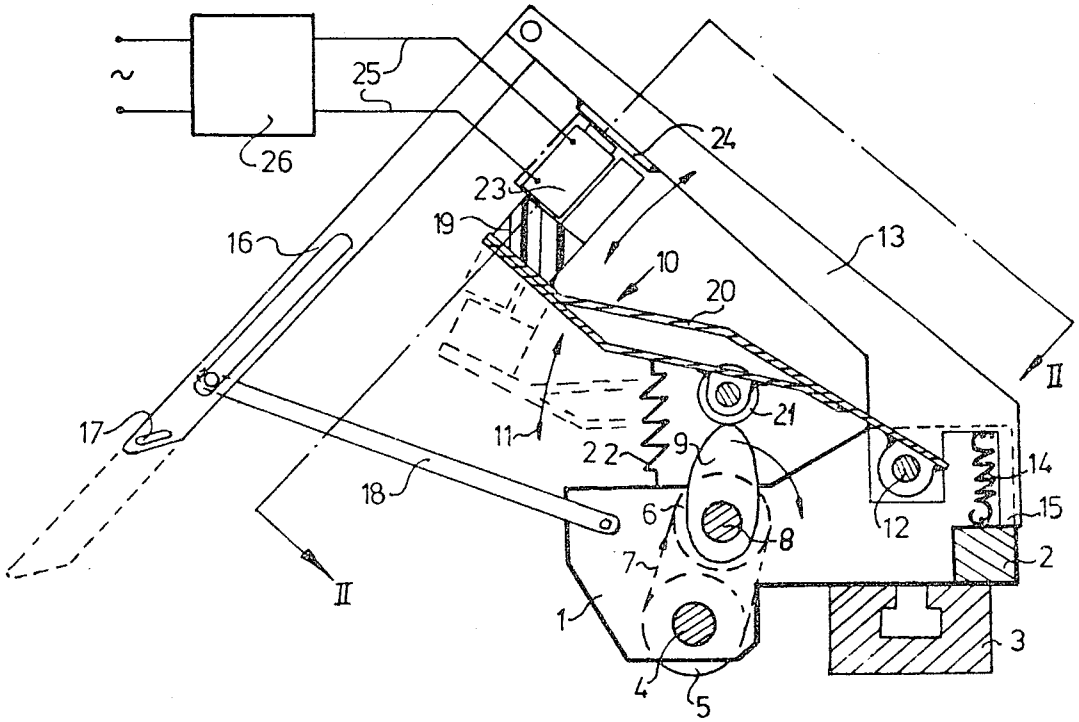
FIG. 1 illustrates a side sectional view of an exemplary embodiment of weft thread-selection apparatus according to the invention, the section being taken substantially along the section line I—I of FIG. 2.
Figure 2:
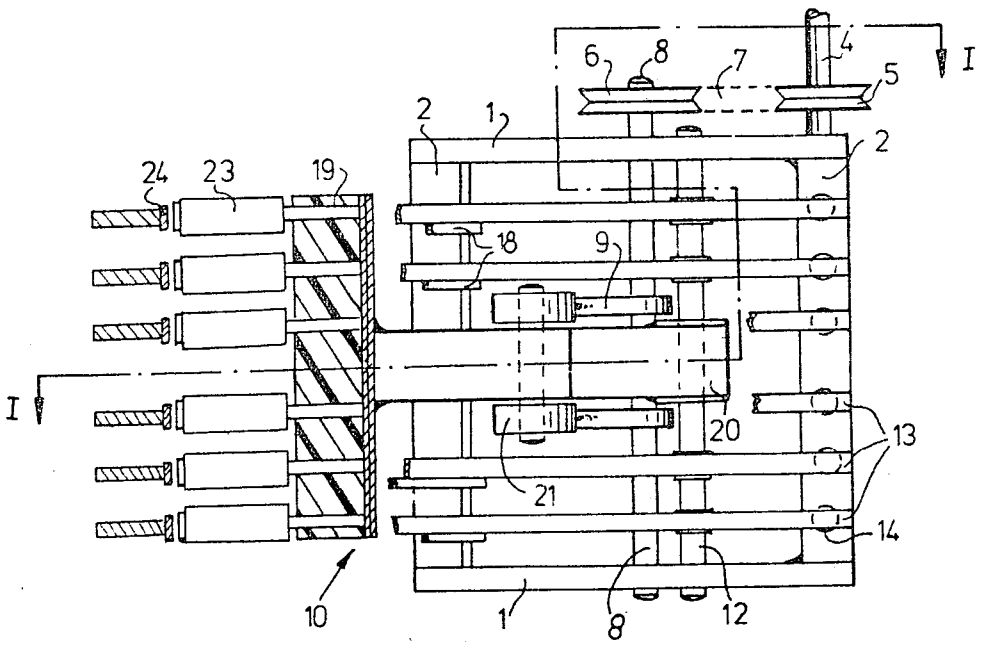
FIG. 2 is a top plan view, again in section, of the weft thread-selection apparatus depicted in FIG. 1, shown on a different scale, and the section being taken substantially along the section line II—II of FIG. 1.

Describing now the drawings, it is to be understood that only enough of the construction of the exemplary embodiment of weft thread-selection apparatus for a weaving machine or loom has been illustrated in the drawings in order to enable those skilled in this art to readily understand the underlying principles and concepts of the invention, while simplifying the showing of the drawings. Turning attention now to FIGS. 1 and 2, the illustrated weft thread-selection apparatus according to the invention, which as a general rule is enclosed by a not particularly illustrated housing, will be seen to comprise side plates 1 which are interconnected with one another by transverse webs or struts 2 or equivalent connection structure. With this basic construction the selection apparatus is secured in any suitable fashion to a carrier or mounting rail 3 of the related weaving machine or loom, as shown in FIG. 1.

At the lower portion of the side plates 1 there is mounted a drive shaft 4 which can be driven in appropriate fashion by the conventional weaving machine drive. This drive shaft 4 carries a belt pulley 5 which is drivingly connected by means of a drive belt 7 with a belt pulley 6 arranged upon a further shaft or shaft member 8. Revolving with the shaft member 8 are two control cams 9 or equivalent structure which produce at a support or carrier element 10 an oscillatory or pivotable movement, in the direction of the double-headed arrow 11, in cycle with the weft thread-insertion frequency of the related weaving machine. The support or carrier element 10 is pivotably or rotatably mounted at its one end about a pivot shaft 12 which, in turn, is non-rotatably mounted at the side plates 1.

This shaft 12 simultaneously serves as the pivot point for a plurality of adjacently arranged oscillatable or pivotal arm members 13 which are located at a predetermined spacing from one another. Each of the oscillatable or pivotal arm members 13 is retained under the action of a related tension spring 14 or equivalent structure in the preparatory position depicted in FIG. 1, and stop or impact means 15 limit such position. These oscillatable or pivotal arm members 13 are hingedly or pivotably connected at their free ends with the one end of a respective thread infeed device, here shown in the form of a thread infeed rod 16. These thread infeed rods or rod members 16 are movable by means of their oscillatable or pivotal arm members 13 out of the preparatory position depicted in full lines in FIG. 1 into the phantom line indicated thread transfer position and back again, this transfer position serving for the transfer of the filling or weft thread to a not here further illustrated but conventional weft thread-insertion device. The not particularly shown weft or filling threads are guided through guide eyelets 17 provided at the free ends of the thread infeed rods 16. The desired linear movement of the weft thread-infeed drive, constituted by the thread infeed rods 16, is accomplished by appropriately related guide rods 18, but of course it is to be understood that other suitable guide means could be used.

The support or carrier element 10 possesses a transverse web or strut 19 which extends over all of the adjacently arranged oscillatable or pivotal arm members 13 and is hingedly connected by means of a central arm member 20 at the shaft 12. This transverse web 19 or equivalent structure also can be supported at the shaft 12 by means of two side arms. In the illustrated arrangement, the transverse web 19 is located below the oscillatable arm members 13.

With the exemplary arrangement the arm member 20 bears by means of a pair of contact rolls or rollers 21, constituting cam followers, at the pair of control cams 9. Contact between the pair of contact rolls 21 and the pair of control cams 9 is maintained by the action of a suitable tension spring 22 or equivalent loading or biasing structure.

Arranged at the transverse web or strut member 19 adjacent to one another and at a spacing essentially corresponding to the spacing of the oscillatable or pivotable arm members 13 are electromagnets 23 of electromagnetic devices 23, 24. These electromagnets 23 are arranged such that the row of these electromagnets 23 extends, in the preparatory position of the entire arrangement, directly beneath the oscillatable or pivotal arm members 13. Each electromagnet 23 can then be magnetically coupled with the therewith operatively correlated oscillatable arm member 13 by means of a magnet armature 24 of the related electromagnetic device and which is secured at the oscillatable arm member 13. Consequently, those electromagnets 23 to which there is applied current, and thus, which are energised, can entrain or drag, along their displacement path into the transfer position shown in broken lines in FIG. 1, the related oscillatable or pivotal arm member 13 which, in turn, moves the related thread infeed rod member 16 out of its preparatory position into the thread transfer position.

In order to be able to control the electromagnets 23 in accordance with a predetermined program their excitation current circuits are connected by means of the lines or conductors 25 with a suitable program control device 26.

From what has been previously described it will be apparent that the inventive weft thread-selection apparatus fulfills all of the requirements placed thereon. In particular, it only possesses very few parts and enables the use of most inexpensive electromagnets. Additionally, the current for the selected electromagnets can be turned-on and turned-off at a random point in time during the return movement of the support or carrier element 10, which enables a relatively large freedom of design in the switching circuitry. Accordingly, the inventive weft thread-selection apparatus can be considered to be extremely robust and functionally reliable. Apart from the aforementioned modifications it is possible to also undertake further changes without departing from the concept of the invention of providing an entraining magnetic coupling between the oscillating support element 10 and the oscillatable or pivotal arm members 13 which are to be adjusted in accordance with a program.

A modification of the exemplary embodiment of the invention contemplates, for instance, arranging at the oscillatable support or carrier element 10 the magnet armatures 24 and securing to the oscillatable arm members 13 the electromagnets 23. In such case the transverse web or strut member 19 is then advantageously constructed itself as the magnet armature.

While there are shown and described present preferred embodiments of the invention, it is to be distinctly understood that the invention is not limited thereto, but may be otherwise variously embodied and practiced within the scope of the following claims. ACCORDINGLY,

What we claim is:

1. A weft thread-selection apparatus for a weaving machine comprising:

a weft thread-infeed device operatively related to each weft thread to be inserted for bringing each such weft thread, prior to its insertion into a shed of the weaving machine, out of a preparatory position into a thread transfer position serving for the thread transfer to a weft thread-insertion device;

said weft thread-infeed device comprising weft thread-infeed rods;

a to-and-fro driven entrainment device with which there can be operatively connected the weft thread-infeed device by means of an electromagnetic control;

said entrainment device comprising an oscillatable support element which can be oscillated in cycle with a predetermined weft thread insertion frequency of the weaving machine;

said support element having a free end;

said free end of the support element carrying at least a first part of electromagnetic devices corresponding in number to the number of weft thread-infeed rods;

said support element having a further end;

a shaft at which there is rotatably mounted said further end of said support element;

oscillatable arm members;

said shaft simultaneously forming a pivot point for said oscillatable arm members;

spring means for retaining each of said oscillatable arm members in a preparatory position;

said oscillatable arm members each being hingedly connected at its free end with a related one of the weft thread-infeed rod; and each of said oscillatable arm members carrying a further part of the electromagnetic devices intended to be cooperatively coupled with a predetermined one of the first part of the electromagnetic devices.

2. The weft thread-selection apparatus as defined in claim 1, wherein:

said electromagnetic devices comprise electromagnets carried by said oscillatable arm members and defining said further part and magnet armatures carried by said support element and defining said first part.

3. The weft thread-selection apparatus as defined in claim 1, wherein:

said electromagnetic devices comprises magnet armatures carried by said oscillatable arm members and defining said further part and electromagnets carried by said support element and defining said first part.

4. The weft thread-selection apparatus as defined in claim 1, wherein:

each of said oscillatable arm members carries a magnet armature of said electromagnetic devices.

5. The weft thread-selection apparatus as defined in claim 1, wherein:

each of said oscillatable arm members carries an electromagnet of said electromagnetic devices.

6. The weft thread-selection apparatus as defined in claim 1, wherein:

said support element comprises a transverse web member;

said transverse web member extending over all of the oscillatable arm members which are arranged adjacent one another; and said transverse web member carrying said first part of said electromagnetic devices which are arranged adjacent one another essentially at the spacing of the oscillatable arm members.

7. The weft thread-selection apparatus as defined in claim 1, wherein:

said electromagnetic devices extend in a row below said oscillatable arm members.

8. The weft thread-selection apparatus as defined in claim 1, further including:

revolving control cam means for actuating said support element.

9. The weft thread-selection apparatus as defined in claim 8, further including:

at least one contact roll by means of which the support element bears at said control cam; and tension spring means engaging at said support element.

10. The weft thread-selection apparatus as defined in claim 1, wherein:

each weft thread-infeed rod has a free end; and a respective guide rod hingedly connected with the free end of a related one of the weft thread-infeed rods.

* * * * *